United States Patent [19]

Draai et al.

[11] 4,254,206

[45] Mar. 3, 1981

[54] PROCESS FOR MAGNETICALLY TRANSFERRING A POWDER IMAGE

[75] Inventors: Willem T. Draai, Helden-Panningen; Josephus W. Rongen, Venlo, both of Netherlands

[73] Assignee: Océ-van der Grinten N.V., Venlo, Netherlands

[21] Appl. No.: 49,203

[22] Filed: Jun. 18, 1979

Related U.S. Application Data

[63] Continuation-in-part of Ser. No. 922,374, Jul. 6, 1978, abandoned.

[30] Foreign Application Priority Data

Jul. 7, 1977 [NL] Netherlands ..... 7707546

[51] Int. Cl.[3] ..... B05D 1/04; B05D 1/06; B05D 5/00

[52] U.S. Cl. ..... 430/126; 427/14.1; 427/47

[58] Field of Search ..... 427/18, 17, 47, 48, 427/14.1; 430/126

[56] References Cited

U.S. PATENT DOCUMENTS

| | | | |
|---|---|---|---|
| 3,250,636 | 5/1966 | Willferth | 427/47 |
| 4,051,484 | 9/1977 | Martin | 427/47 |

*Primary Examiner*—Bernard D. Pianalto
*Attorney, Agent, or Firm*—Albert C. Johnston

[57] ABSTRACT

Transfer of a powder image from a material carrying the image, such as a photoconductive material utilized for indirect electrophotographic copying, is effected magnetically by employing permanently magnetizable developing powder for forming the image, magnetizing the powder image, and bringing the powder image into contact with a first receiving support made of soft magnetic material so that this support is magnetizable and possesses a substantially uniform magnetic permeability over its whole surface but becomes magnetized so weakly that the powder image after being transferred to the first receiving support can be transferred readily from it, directly or indirectly, to a final receiving support which may be plain copy paper. The magnetizable material of the first receiving support has a coercive force of less than about 90 Oersteds and a relative magnetic permeability of at least 2.

15 Claims, 1 Drawing Figure

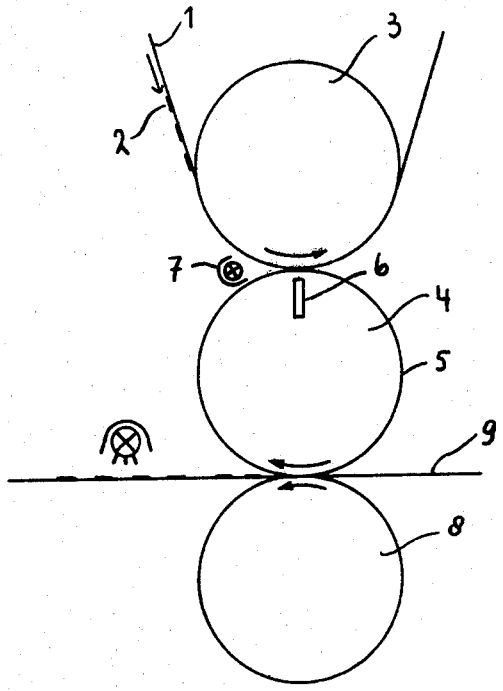
1
2
3
4
5
6
7
8
9

PROCESS FOR MAGNETICALLY TRANSFERRING A POWDER IMAGE

This is a continuation-in-part of pending application, Ser. No. 922,374 filed July 6, 1978 and now abandoned.

This invention relates to a process for magnetically transferring a powder image formed of permanently magnetizable powder.

In the so-called indirect electrophotographic copying system as it has been practically used, a latent electrostatic image is formed in a photoconductive material and then is developed with a developing powder, after which the resultant powder image is transferred and finally is fixed to a receiving material, commonly of plain paper. After the transfer of the powder image the surface of the photoconductive material is cleaned and used for another copying run.

The transfer of the powder image to the receiving material is usually effected under the influence of an electric field generated between the photoconductive material and the receiving material. Such electric transfer has a disadvantage in that blurring of the images occurs because of powder particles being dispersed by electric discharges which occur continuously in the transfer zone. A further disadvantage of electrical transfer is that the results obtained with it in regard to the efficiency of transfer and the quality of the transferred image depend on the atmospheric conditions and the electric properties of the developing powder and the receiving material.

In order to enable transfer of a powder image independently of atmospheric conditions and of the electric properties of developing powder and receiving material, it has been proposed to use a magnetically attractable developing powder for the development of the electrostatic image and to transfer the powder image under influence of the magnetic field of a permanent magnet or electromagnet located behind the receiving material. However, image blurring also occurs with this magnetic transfer method, because particles of developing powder move over the receiving material under influence of the magnetic field during delivery of the receiving material out of the transfer zone.

This blurring of images can be prevented by simultaneously transferring the powder image magnetically and fixing it with the aid of heat, as described in U.S. Pat. Nos. 3,093,039 and 3,106,479. In such processes, however, since the heat-fixation of the powder image is carried out while the image is still in contact with or very near to the photoconductive material, there is danger that melted or softened particles of developing powder may deposit on the photoconductive material and, by adhering permanently, render this material no longer usable. Morover, a further disadvantage exists in the process according to U.S. Pat. No. 3,093,039, in which transfer and fixing of the powder image are effected simultaneously under a high frequency magnetic field, in that a very great quantity of energy is required in order to effect the desired fixing of the image. On the other hand, in the process according to U.S. Pat. No. 3,106,479, in which a heating element is located in the transfer zone very near to the photoconductive material, the photoconductive material is also heated considerably with the result that its photoelectric properties decrease quickly so that only a relatively limited number of copies can be made by its use.

U.S. Pat. No. 3,804,511 describes, with reference to FIG. 8 thereof, a process for the formation of a latent magnetic image from a powder image formed electrophotographically on a photoconductive material with the use of magnetically attractable developing powder. In that process, a uniform layer of permanently magnetizable material magnetized to a fine linear pattern is brought into contact with the image-carrying surface of the photoconductive material, and by the action of a magnetic erasing head located behind the photoconductive material the magnetized layer is demagnetized in the areas that are not shielded by image areas of the powder image. A latent magnetic image is thus formed in the magnetized layer. During its formation a part of the magnetically attractable developing powder is transferred to this magnetic image. However, only a small quantity of developing powder is transferred, so that, without more, the process described is not useful for image transfer in an indirect electrophotographic copying system. The process also has a further handicap in that a wide magnetic head is required for magnetizing the permanently magnetizable layer, which head must be manufactured with great precision in order to provide a magnetic field of uniform strength over its full working width.

The principal object of the present invention is to provide an improved process for the transfer of a powder image formed of a permanently magnetizable powder, by which a high transfer efficiency is achieved and sharp images are obtained without need for fixing the powder image on the receiving support simultaneously with the magnetic transfer. Thus, the process of this invention overcomes the disadvantages of the magnetic transfer processes above mentioned, including those of the processes described in U.S. Pat. Nos. 3,093,039 and 3,106,479.

According to this invention the powder image is magnetically transferred to a first receiving support that possesses a substantially uniform magnetic permeability over its whole surface and contains magnetizable material of the kind known as soft magnetic material, which makes this support sufficiently magnetic that the transfer to it is effected by magnetizing the powder image and bringing it into contact with the first receiving support, but which becomes magnetized so weakly that the powder image can be transferred readily from the first receiving support directly or indirectly to a final receiving support. By the provision of a uniform or almost uniform magnetic permeability over the whole surface of the first receiving support, the magnetizable material of which has a weak yet effective attraction for the powder image, powder particles transferred to the first receiving support are prevented from being moved over the surface of this support in a way which would blur or disturb the image.

The magnetizable material in the first receiving support preferably is a soft magnetic, ferro-or ferri-magnetic material that has a coercive force of less than about 90 Oersteds and a relative magnetic permeability of at least 5. Materials having a lower relative permeability, for instance of between 2 and 5, can also be used, but a sufficiently high transfer efficiency usually can be obtained with such materials only if during the transfer of the powder image an auxiliary magnetic field is generated and/or the powder image to be transferred is strongly magnetized. Magnetizable materials having a relative permeability lower than 2 can usually not be used, because the transfer efficiencies obtained with them are too low.

The first receiving support may consist entirely of the magnetizable material, but it may also consist of a lowly magnetizable or non-magnetizable support on which a layer of the magnetizable material has been applied. Examples of suitable first receiving supports are supports composed of iron, cobalt or nickel or soft magnetic alloys of cobalt and nickel or of nickel, copper and iron; also supports which are composed of copper, glass, aluminum, paper or plastic having applied thereto, with or without the aid of one or more adhesive layers, a layer of the magnetizable material, which, for instance, may be composed of any of the abovementioned metals or metal alloys, or of a fine dispersion of magnetizable powder in a filmforming binding agent. Further, the first receiving support may also be a self-supporting plastic film in which magnetizable powder is finely dispersed.

When the first receiving support contains the magnetizable material in the form of a dispersion in a filmforming binding agent, the magnetizable material should be dispersed uniformly in the binding agent in order to provide a substantially uniform magnetic permeability over the whole surface of the first receiving support.

In such cases, the particle size of the magnetizable material preferably is smaller than 1 micrometer, because with such particles the most uniform layers are obtained. The weight ratio between magnetizable material and filmforming binder may amount to from 3:1 to 10:1 and preferably is between 5:1 and 8:1.

The transfer to the first receiving support of the powder image formed of permanently magnetizable powder is effected by magnetizing the powder image and bringing it into contact with the first receiving support. The magnetizing of the powder image may be effected before the image is brought into contact with the first receiving support, but it is simpler to magnetize the image while it is in contact with the first receiving support. In the latter practice the powder image on a material carrying it is brought into contact with the first receiving support and a magnetic field sufficiently strong to magnetize the powder image is generated in the contact zone between the first receiving support and the material carrying the powder image, so that when the first receiving support is separated from that material the magnetized powder is held magnetically to the first receiving support.

The powder image can be magnetized before it is brought into contact with the first receiving support by conveying the material carrying the powder image through a magnetic field of sufficient strength. However, this usually makes it recommendable to take measures in order to prevent that, during the introduction into and the delivery out of the magnetizing zone, the powder particles can be moved under influence of the external magnetic field, and thus cause image interferences. Movement of the powder particles can for instance be prevented by pressing the powder image in and near the magnetizing zone against a diamagnetic material.

The powder image can also be magnetized during the development of this image, as by employing magnetic means, for instance a known magnetic brush developing device, for applying the magnetizable powder to the latent electrostatic image to be developed.

The image transferred to the first receiving support is subsequently transferred in a known way, directly or indirectly, to a final receiving support, which will usually be plain paper.

Direct transfer of the powder image to the final receiving support can be effected, for instance, in the manner described in the above-mentioned U.S. Pat. No. 3,804,511. In that method, the final receiving support is pressed against the powder image and the image transferred as a result of the pressure, after which the image is fixed suitably on the final receiving support, for instance by heating. Indirect transfer of the powder image to the final receiving support can be executed, for instance, in the manner described in British Pat. No. 1,245,426, in which the powder image is transferred to a resilient medium under influence of pressure and subsequently is transferred from the resilient medium to the final receiving support, and is fixed at the same time, under influence of pressure and heat.

The process of this invention is especially attractive for use in so-called indirect electrophotographic copying systems in which a permanently magnetizable developing powder, either electrically conductive or non-conductive, is used for the development of the electrostatic image. For this use, in comparison with known processes, the present process has a great advantage in that a good transfer of the powder image is obtained under conditions that are very favorable for prolonged service life of the photoconductive medium, which usually is quite vulnerable to deterioration. Because of the fact that no heat needs be supplied to the powder image to be transferred, thermal change of the photoconductive medium is prevented; and since only a slight contact pressure is required between the photoconductive medium and the first receiving support, mechanical stresses and consequent changes of the photoconductive surface are limited to a minimum. In the latter respect the process differs advantageously from the process described in British Pat. No. 1,245,426.

When applying the present process in indirect electrophotographic copying systems, the transfer efficiency can be increased even more by exposing away before or during the transfer the electrostatic charges that hold the powder image to the photoconductive medium.

The process of the invention can be employed for transferring powder images that have been formed of permanently magnetizable developing powders. Such permanently magnetizable developing powders are known. They usually consist of thermoplastic resin particles in which permanently magnetizable powder particles, for instance a powder as mentioned on page 12 of Dutch patent application No. 6806473, are finely dispersed in a quantity usually lying between 30 and 70 percent by weight. The resin particles may also contain additions such as coloring materials or materials which make the resin particles electrically conductive. These additions may be finely dispersed in the resin particles or may be deposited on their surface.

The invention will be further understood from the following illustrative example.

EXAMPLE

A photoconductive belt made as described in the example of British Pat. No. 1,408,252 was successively charged electrostatically and imagewise exposed in known manner, thus being provided with a latent charge image which was developed by the magnetic brush method with a permanently magnetizable, one-component developing powder. The developing powder had particle sizes of between 10 and 30 micrometers and a specific resistance of $3\times10^8$ ohm.cm, and consisted of thermoplastic particles which contained 40 percent by weight of epoxy resin and 60% by weight of permanently magnetizable ν-ferric oxide particles and were coated with a layer of electrically conductive carbon on their surface. The developing powder was prepared as described in Example 3 of pending U.S. patent application Ser. No. 780,431.

BRIEF DESCRIPTION OF THE FIGURE

The image thus formed on the photoconductive belt was transferred to a receiving paper, according to the process of the present invention, by conveying the photoconductive belt through a transfer device having an arrangement as illustrated schematically in the accompanying drawing.

DETAILED DESCRIPTION OF THE FIGURE

In this transfer device, the photoconductive belt 1 carrying the powder image 2 to be transferred is passed over a supporting roller 3 by which it is brought into contact, under slight contact-pressure, with an image receiving roller 4. The image receiving roller 4 comprises a sleeve 5 on the outside of which a layer of nickel has been applied with a thickness of about 4 micrometers. The supporting roller 3 and the sleeve 5 are driven in the direction indicated by the arrows. A stationary bar magnet 6 extending in axial direction is installed inside the rotating sleeve 5 in such manner that the field of this magnet is effective only in the nip between the roller 3 and the sleeve 5. The magnetic field generated in the nip has, for instance, a strength of about 24 kA/m.

The magnet 6 effects the magnetizing of the powder images conveyed into the nip between the roller 3 and the sleeve 5, and it serves further as an auxiliary magnet aiding the transfer of the magnetized powder image to the magnetizable sleeve 5. For further improving the transfer efficiency, a lamp 7 is installed just ahead of the nip between the roller 3 and the sleeve 5, which lamp exposes away the charge image still present on the photoconductive belt 1.

The powder image transferred to the sleeve 5 is transferred from the surface of this sleeve, under pressure, to a sheet of receiving paper 9 supplied from a stock pile of plain paper. This second transfer is effected in the nip between the sleeve 5 and an elastic pressure roller 8.

Sharp copies of very good quality are obtained in this way. The transfer efficiency upon transferring the powder image to the sleeve 5 was equivalent to the efficiency usually achieved with electric transfer methods. Equally good results were obtained when, instead of a layer of nickel, the sleeve 5 was provided with a surface layer consisting of a fine dispersion of soft magnetic ν-ferric oxide particles, for instance the material commercially available as OC 4 pigment (Philips, Netherlands), in epoxy resin in the volume ratio of 1:1.

What is claimed is:

1. In a process for transferring a powder image formed of permanently magnetizable developing powder, in which process the powder image is magnetically transferred to a first receiving support and subsequently is transferred from the first receiving support directly or indirectly to a final receiving support, the improvement comprising that the first receiving support is a magnetizable support that possesses a substantially uniform magnetic permeability over its whole surface, the magnetizable material of which is soft magnetic material having a relative magnetic permeability of at least 2, and the powder image is transferred to the first receiving support by magnetizing the powder image and bringing it into contact with the first receiving support.

2. A process according to claim 1, said magnetizable material of the first receiving support having a coercive force of less than 90 Oersteds.

3. A process according to claim 1 or claim 2, said magnetizable material of the first receiving support possessing a relative magnetic permeability of at least 5.

4. A process according to claim 1 or 2, said magnetizing of the powder image being effected while the powder image is in contact with the first receiving support.

5. A process according to claim 1, said first receiving support comprising a sleeve having a magnetizable surface and being rotated about a permanent magnet the magnetic field of which is confined to substantially the zone of the contact of the powder image with said surface.

6. A process according to claim 5, said sleeve comprising a cylindrical roller of substantially non-magnetizable material having thereon a surface layer of a magnetizable metal or alloy having a relative magnetic permeability of at least 5.

7. A process according to claim 5, said sleeve comprising a cylindrical roller of substantially non-magnetizable material having thereon a magnetizable surface layer of soft magnetic particles dispersed in a thermoplastic binder.

8. A process according to claim 7, the size of said particles being smaller than 1 micrometer and said surface layer containing said particles and said binder in a weight ratio of between 5:1 and 8:1.

9. In an electrophotographic process in which a latent electrostatic image is formed in a photoconductive material, said latent image is developed with a permanently magnetizable powder and the resultant powder image is transferred magnetically to a receiving support, the improvement which comprises that the magnetic transfer of the powder image is effected to a first receiving support by a process according to claim 1, 6 or 7.

10. In a process for transferring from an image carrier a powder image formed of permanently magnetizable powder particles, wherein the image is transferred magnetically from the carrier to a first receiving support and subsequently is transferred from the latter directly or indirectly to a final receiving support, the improvement which comprises magnetically transferring the powder image from said carrier by magnetizing the powder image and bringing it into contact with a magnetizable first receiving support that possesses a substantially uniform magnetic permeability over its whole surface and of which the magnetizable material is soft magnetic material having a relative magnetic permeability of at least 2, and subsequently at a location away from said carrier transferring the powder image from said first receiving support directly or indirectly to a final receiving support.

11. A process according to claim 10, said magnetizable material of the first receiving support having a coercive force of less than 90 Oersteds and a relative magnetic permeability of at least 5; said first receiving support comprising a rotatable sleeve having said magnetizable material at its surface; said magnetic transferring being effected by moving the powder image on said carrier in contact with said sleeve surface while rotating said sleeve about a permanent magnet the effective magnetic field of which is confined to substantially the zone of the contact of the powder image with said surface.

12. A process according to claim 11, said sleeve comprising a cylindrical roller of substantially non-magnetizable material having thereon a surface layer of magnetizable metal or alloy constituting said magnetizable material.

13. A process according to claim 11, said sleeve comprising a cylindrical roller of substantially non-magnetizable material having thereon as said magnetizable material a surface layer of soft magnetic particles dispersed in a thermoplastic binder, the size of said magnetic particles being smaller than 1 micrometer and said surface layer containing said magnetic particles and said binder in a weight ratio of between 5:1 and 8:1.

14. In an electrophotographic process in which a latent electrostatic image is formed in a photoconductive material, said latent image is developed with a permanently magnetizable powder and the resultant powder image is transferred magnetically to a receiving support from which it subsequently is transferred to a final receiving support, the improvement which comprises that the powder image is transferred magnetically to the first receiving support and from it directly to the final receiving support by a process according to claim 12 or claim 13.

15. A process according to claim 3, said magnetizing of the powder image being effected while the powder image is in contact with the first receiving surface.

* * * * *